US005081330A

United States Patent [19]

Brandberg et al.

[11] Patent Number: 5,081,330

[45] Date of Patent: Jan. 14, 1992

[54] PACKAGE WITH MICROWAVE INDUCED INSULATION CHAMBERS

[75] Inventors: Lawrence C. Brandberg, Crystal; Jeffrey T. Watkins, St. Paul, both of Minn.

[73] Assignees: Golden Valley Microwave Foods Inc., Edina, Minn.

[21] Appl. No.: 550,993

[22] Filed: Jul. 11, 1990

[51] Int. Cl.[5] ..... H05B 6/80; B65R 25/22

[52] U.S. Cl. ..... 219/10.55 E; 219/10.55 F; 426/107; 426/111; 426/234; 426/243; 99/DIG. 14

[58] Field of Search ..... 219/10.55 E, 10.55 F; 426/107, 109, 110, 111, 113, 234, 241, 243; 99/DIG. 14

[56] References Cited

U.S. PATENT DOCUMENTS

| | | | |
|---|---|---|---|
| 4,132,811 | 1/1979 | Standing et al. | 219/10.55 E |
| 4,190,757 | 2/1980 | Turpin | 219/10.55 E |
| 4,196,331 | 4/1980 | Leveckis et al. | 219/10.55 E |
| 4,219,573 | 4/1980 | Borek | 426/107 |
| 4,316,070 | 2/1982 | Prosise et al. | 219/10.55 E |
| 4,553,010 | 11/1985 | Bohrer et al. | 219/10.55 E |
| 4,705,927 | 11/1987 | Levendusky et al. | 219/10.55 E |
| 4,713,510 | 12/1987 | Quick | 219/10.55 E |

*Primary Examiner*—Philip H. Leung
*Attorney, Agent, or Firm*—James V. Harmon

[57] ABSTRACT

The present invention provides an insulating microwave heating package with at least one and preferably a multiplicity of latent, uninflated or potential insulation chambers capable of inflating when exposed to microwave energy. The package includes at least two sheets of material bonded together at selected points, patches or along seal lines separated by unsealed areas which define unfilled inflation chambers between the lines, patches or points. Upon exposure to microwave energy, the package and its contents become heated. As a result of this heating process, the unfilled chambers also become heated, causing them to become filled with hot expanding air or moisture vapor. These chambers serve as insulation for the package and enhance heating of the food by reducing heat loss from the package.

9 Claims, 4 Drawing Sheets

PACKAGE WITH MICROWAVE INDUCED INSULATION CHAMBERS

FIELD OF THE INVENTION

The present invention relates to packaging and more particularly to packaging for heating foods in a microwave oven.

BACKGROUND OF THE INVENTION

While many packages for heating food in a microwave oven have been successful, heat loss often interferes with achieving optimum results. For example, in popping corn, heat losses can reduce the volume of the popped corn and increase the number of "old maids", especially in low powered ovens. This can result in consumer dissatisfaction. Insulation for microwave packaging has in the past been bulky and requires assembly steps and materials which make the package more expensive. In addition, the insulation has been located only in the bottom portion of the package, i.e. the portion resting on the floor of the microwave oven, thereby reducing heat loss only in that area. One example is described in U.S. Pat. No. 4,219,573 which provides enough insulation to prevent the loss of at least about 18 cal. per gram of popcorn. It has now been discovered that excellent results can be provided by preventing the loss of only about 9 calories per per gram of popcorn. In addition, the insulation materials—cork, wood, corrugated pad or ceramic paper—proposed in U.S. Pat. No. 4,219,573 are not required in the present invention. This reduces the cost of the package substantially. Insulation previously used reduces the cooling rate of the food when the package is chilled or frozen. It has now been discovered that the microwave energy itself can be used to induce the formation in situ of an insulation structure without adding material to the package. In developing the present invention, it has also been discovered that the most efficient formation of the insulation structure can be achieved by augmenting the heat supplied by the microwave energy alone to the unformed potential insulation before the insulation structure actually comes into being.

In view of the deficiencies of the prior art, it is a major object of the invention to reduce the loss of heat from microwave packaging without increasing the cost of the package or adding materials, to reduce heat loss in one or more selected areas or throughout the entire package, thereby permitting foods contained in the package to be cooked or heated more efficiently and to enable the package to be chilled or frozen as efficiently as a bag with no insulation.

These and other more detailed and specific objects of the invention will be better understood by reference to the following detailed description and figures which illustrate by way of example but a few of the various forms of the invention within the scope of the appended claims.

SUMMARY OF THE INVENTION

The present invention provides an improved microwave heating package with at least one and preferably a multiplicity of latent, uninflated or potential insulation chambers capable of becoming inflating when exposed to microwave energy. The package includes a package-enclosing wall having inflatable means in the wall adapted to expand the thickness of the wall upon exposure to microwave energy. In a preferred embodiment, the wall includes two sheets of material including at least one flexible sheet. The sheets are bonded together at selected points, patches or along seal lines with unsealed areas between them to define unfilled inflation chambers between the lines, patches or points. A microwave susceptor is preferably placed adjacent to the potential inflation chambers. Upon exposure to microwave energy, the package and its contents become heated. As a result of this heating process, the unfilled chambers between the patches, points or seal lines also become heated, causing them to become filled with heated air or vapor.

THE FIGURES

DETAILED DESCRIPTION OF THE INVENTION

Figure 1:
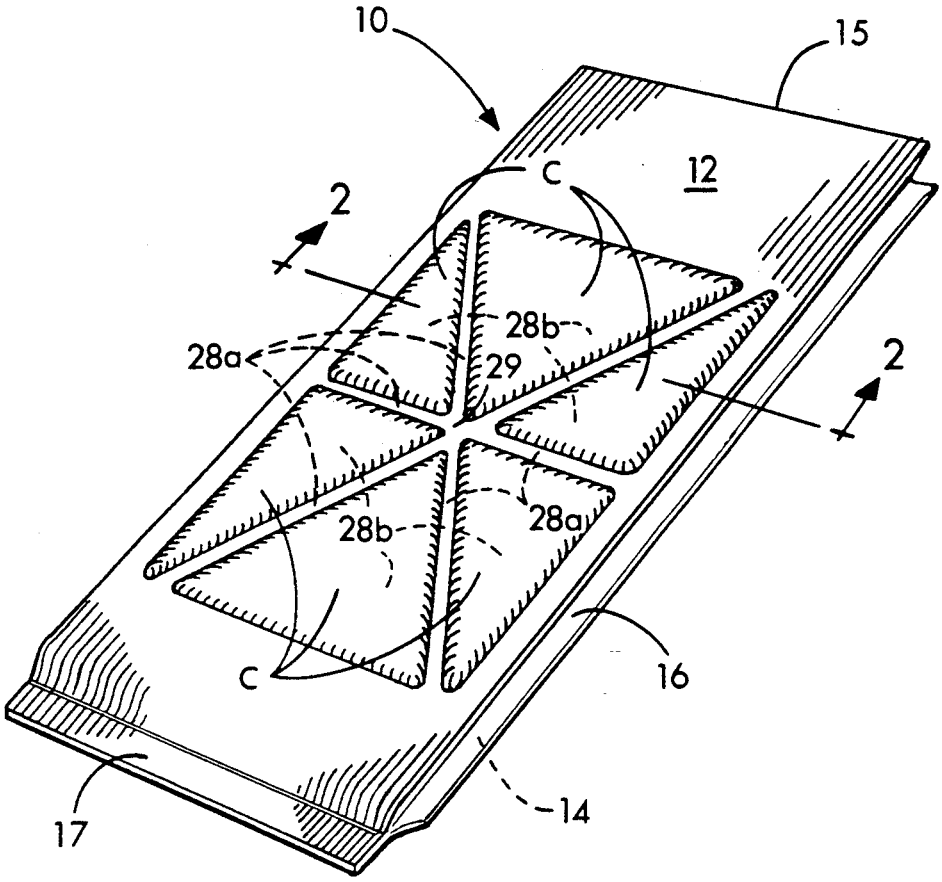
FIG. 1 is a perspective view of a package embodying one form of the invention.
Figure 2:
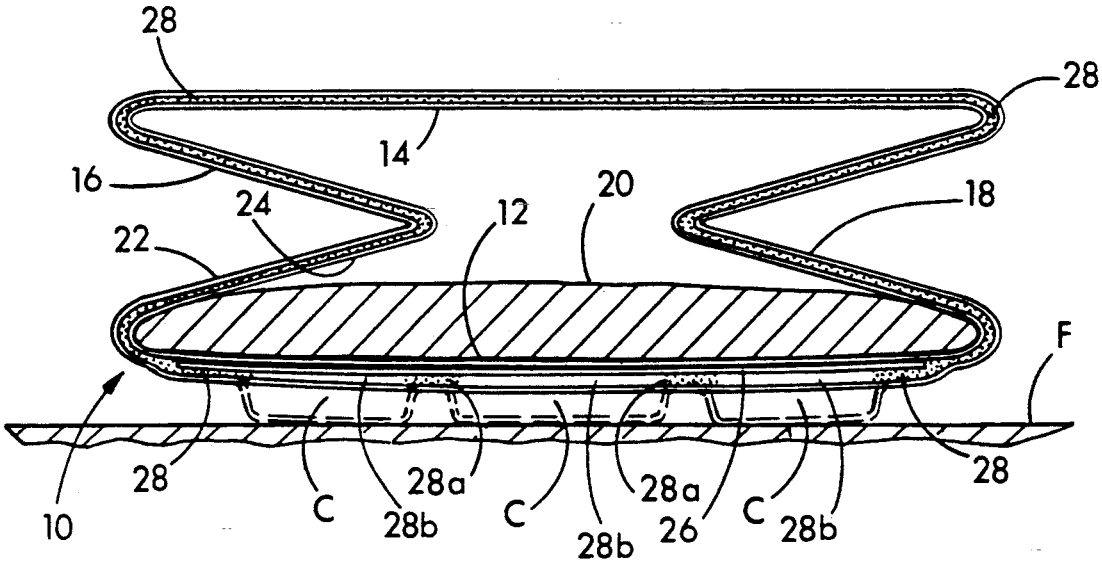
FIG. 2 is a transverse sectional view taken on line 2—2 of FIG. 1.
Figure 3:
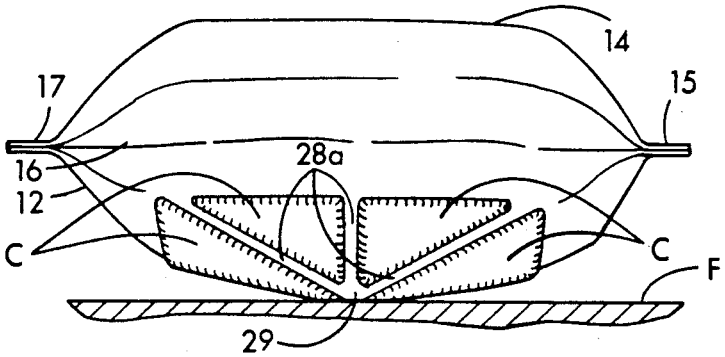
FIG. 3 is a side view of the package of FIG. 1 as it appears after being heated in a microwave oven.

FIGS. 1, 2 and 3 illustrate a package, in this case a collapsible bag 10 embodying the invention. The bag 10 is formed from paper and includes a lower face 12, an upper face 14, gussets 16 and 18, and a bottom seal 17. Before the bag 10 is filled with food, it is open at one end which serves as a mouth 15. The bag 10 can be filled through the mouth 15 with any suitable food 20 such as a charge of unpopped popcorn and shortening which is to be popped within the bag 10 by microwave energy supplied by a microwave oven. The mouth 15 of the package is then sealed shut. The bottom wall or lower face 12 of the bag is shown in FIG. 1. During the popping operation the bag 10 is oriented so that the bottom wall 12 faces downwardly with the food 20 in contact with it as shown in FIGS. 2 and 3.

As can be seen in FIG. 2, the bag 10 is made up of flexible outer and inner layers of paper 22 and 24 which are glued, i.e. laminated, together by means of an adhesive 28. However, at least on the lower face 12 of the bag 10, the pattern of adhesive 28 is provided such that there exists a series of strips, dots or patches of adhesive **28*a* separated by areas with no adhesive 28*b*. This provides several latent or potential inflation chambers C. The sheets 22 and 24 can, for example, comprise 30 lb. bleached kraft paper and 30 lb. greaseproof kraft paper, respectively. The adhesive 28 can comprise a suitable heat-resistant adhesive such as a vinyl chloride emulsion adhesive, an ethylene vinyl chloride emulsion adhesive or a polyvinylacetate polymer emulsion adhesive such as Duracet-12® adhesive manufactured by Franklin International, Inc. of Columbus, Ohio. Other adhesives will be apparent to those skilled in the art. The adhesive 28***a* can be applied in any suitable manner, for example by a patterned adhesive applicator roll (not shown). No effort has to be made to provide a space or air chamber of any kind between the sheets 22 and 24 in the unsealed areas 28*a*. It is believed, however, that a small space exists and that a small amount of air will be present between the two sheets. The important requirement is simply that the sheets be unbonded in the areas 28*b*.

Between the inflation chambers C and the inner wall 24 of the bag 10 is a susceptor 26 of any suitable known construction, for example a flexible sheet of plastic film having a microwave interactive coating on one or both surfaces. It is preferred that the susceptor 26 be located adjacent to the food 20 and that the expandable chambers C be on the opposite side of the susceptor 26 from the food 20 to maximize heat transmission to the food and minimize loss to the oven floor F. Microwave interactive susceptors of various compositions are well known to the art for heating food. Examples are described in U.S. Pat. Nos. 4,735,513; 4,878,765; 4,190,757 and 4,267,420. It will be seen in FIG. 2 that the sheets 22 and 24 are laminated together in flat condition. That is to say, with the adjacent surfaces at the location of the unbonded areas 28*b* which define the latent chambers C either in contact or nearly in contact.

It has now been discovered that when a package having latent chambers C as described is heated in a microwave oven, the unsealed sections 28*b* will expand as the result of the expansion of air or moisture vapor or, most probably, both to produce inflated chambers C and create a microwave-induced layer of insulation between the food 20 and the floor of the oven F. The chambers C are often about ¼" in height. While the precise mechanism of expansion of these of chambers during microwave heating is not known with certainty, it is believed that it cannot be explained fully as a result of air expansion because no effort is necessary to assure that air is present in the unexpanded chambers. Consequently, it is believed that moisture vapor may be partially responsible for the expansion of the chambers. The susceptor 26 typically reaches a temperature of about 325° F. to 400° F., and at this temperature, air and moisture vapor present in the unexpanded chambers can expand to ten times their original volume.

It will be noted that no additional material is required to provide the insulation chambers C. Moreover, the insulation layer provided by the chambers C does not rigidify the package as a layer of corrugated cardboard will do as described in U.S. Pat. No. 4,219,573. In addition, the food can be chilled or frozen as efficiently as in an uninsulated package.

By arranging the adhesive strips 28*a* in a star pattern which intersects at a center point 29 near the center of the bag 10, it has been discovered that the bag tends to develop a conical bottom surface that has an apex at the intersection point 29 of the adhesive bands 28*a*. This is desirable since it tends to clump the unpopped popcorn near the center of the bag during the popping operation, thereby keeping it at a location where heat can be transferred to it most effectively so as to enhance the popping effect. Thus, in this configuration, the chambers C tend to shape the package 10 and act as a conical truss or form for concentrating the charge of popcorn and shortening 20 at a center point. In an alternative form of the invention, if a series of elongated parallel chambers C are employed, they will help to unfold the bag 10 which is shipped in a folded condition as they inflate during the microwave heating process.

The susceptor 26, instead of comprising a separate sheet of material, can be a coating applied as a liquid to the outer surface of the inner sheet 24 and dried in the manner of a printing ink. In this case, the susceptor coating will contain a microwave interactive heating substance in particulate form which is bonded to the sheet 24 as a part of the coating which makes up the susceptor 26.

It can also be seen that an insulation effect is achieved without insulation material being added to the package. In this sense the bag is self-insulating, the height of the chambers C providing insulation. Since nothing is added, the bag 10 remains supple, flexible, pliable and foldable. This is important since the ends of the bag 10 are folded over a center portion containing the popcorn 20. It will also be noted that the insulation is formed dynamically during microwave heating.

Many variations can be made. For example, a moisture or vapor releasing substance can be provided in the susceptor 26 or at least in communication with the chambers C to release gas, vapor or fumes during the heating process. One example is a vapor-releasing mineral hydrate as described in co-pending patent application Ser. No. 07/456,159 entitled MICROWAVE SUSCEPTOR WITH ATTENUATOR FOR HEAT CONTROL, now U.S. Pat. No. 4,970,358.

Because the invention provides a substantial improvement in heating of food, the size or amount of the susceptor 26 can be reduced in some cases, which is an advantage under certain conditions, for example when the susceptor 26 tends to burn or scorch the package.

Figure 4:
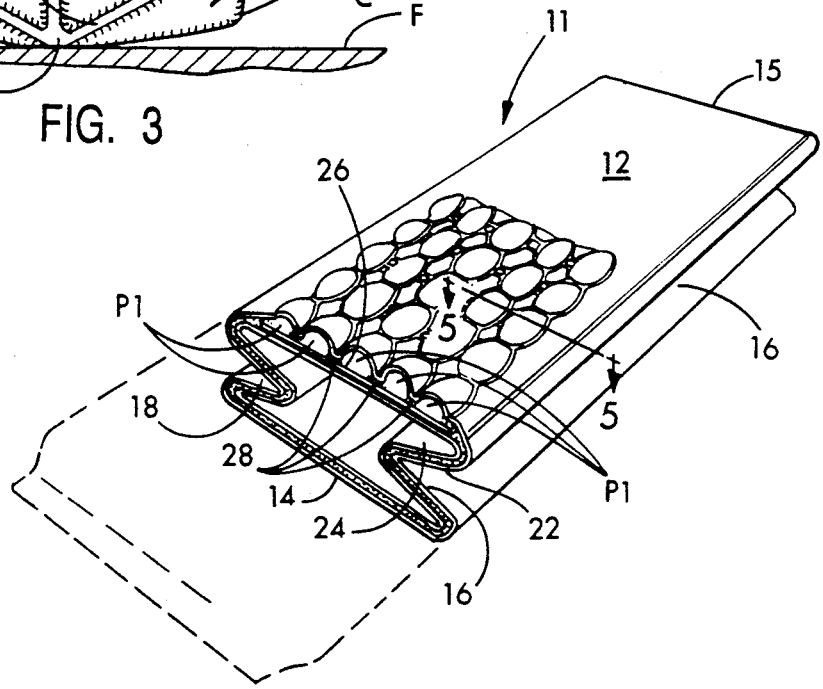
FIG. 4 is a perspective view partly broken away of another form of the invention.
Figure 5:
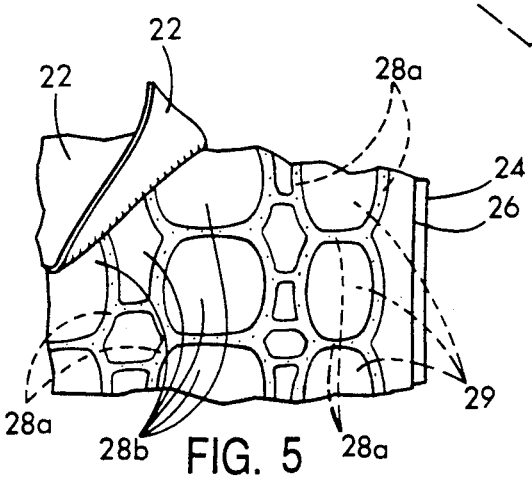
FIG. 5 is a partial transverse sectional view taken on line 5—5 of FIG. 4 with the outer wall of the package partially drawn back.
Figure 6:
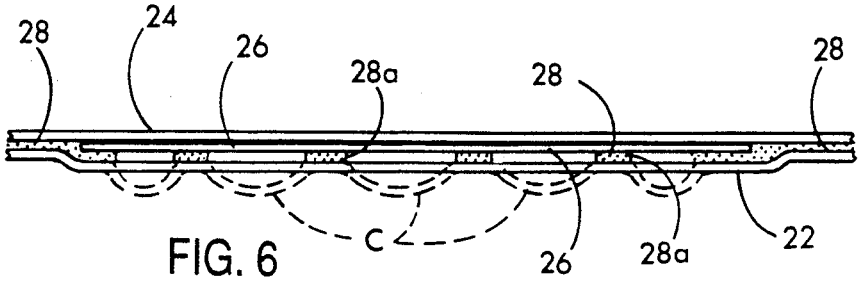
FIG. 6 is an enlarged cross-sectional view of a portion of a package in accordance with the invention showing inflation chambers in unexpanded and expanded condition (dotted lines)

Another form of the invention is shown in FIGS. 4, 5 and 6 wherein the same numerals refer to corresponding parts in the embodiment illustrated above. In this embodiment, the primary difference from FIGS. 1–3 is that the inflation chambers C have a different pattern. In FIGS. 4–6, the inflation chambers C comprise a plurality of relatively small blisters arranged in rows.

As seen in FIGS. 4–6, the bag indicated generally at 11 includes a lower face 12, an upper face 14, gussets 16 and 18, and susceptor 26 as described above. Adhesive 28 is employed for bonding the sheets 22 and 24 together. In the area where the chambers C form during heating, the adhesive 28 is arranged as a plurality of circles of adhesive 28*a* having adhesive-free areas 28*b* between them. Before heating, the condition of the latent inflation chambers C is shown as narrow spaces between the circles of adhesive 28*a*. When the package is placed in a microwave oven and exposed to microwave energy, the heat produced by the microwave energy, and particularly that produced by the susceptor 26, will cause the latent or potential inflation chambers C corresponding to the adhesive-free areas 28*b* to expand as shown by dotted lines in FIG. 6 and solid lines in FIG. 4 to produce the inflation chambers C which provide an insulating effect for reducing heat loss from the food and the susceptor 26.

The invention can be used in connection with a variety of foods, such as popcorn, pizza, French fries, griddle food (e.g. French toast, pancakes, waffles), rolls, doughnuts and the like. Since the sheets of paper 22 and 24 are flexible, they are better able to conform to the surface of an irregularly shaped food product, such as the lower surface of a pizza crust, than a flat stiff object such as a sheet of corrugated cardboard. This promotes heat transmission into the food.

Figure 7:
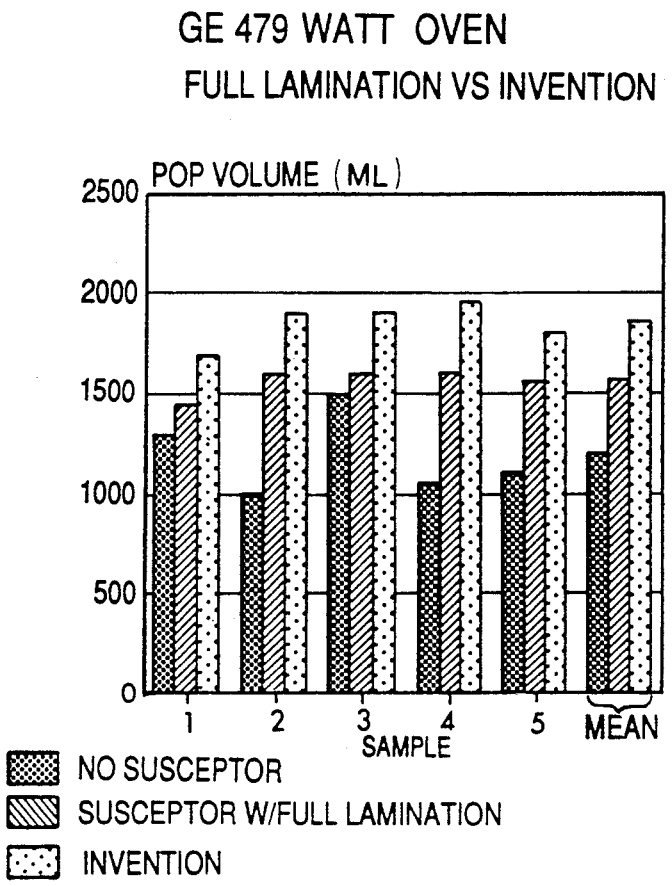
FIG. 7 is a bar chart comparing the popped volume of popcorn popped in a package with and without the present invention.
Figure 8:
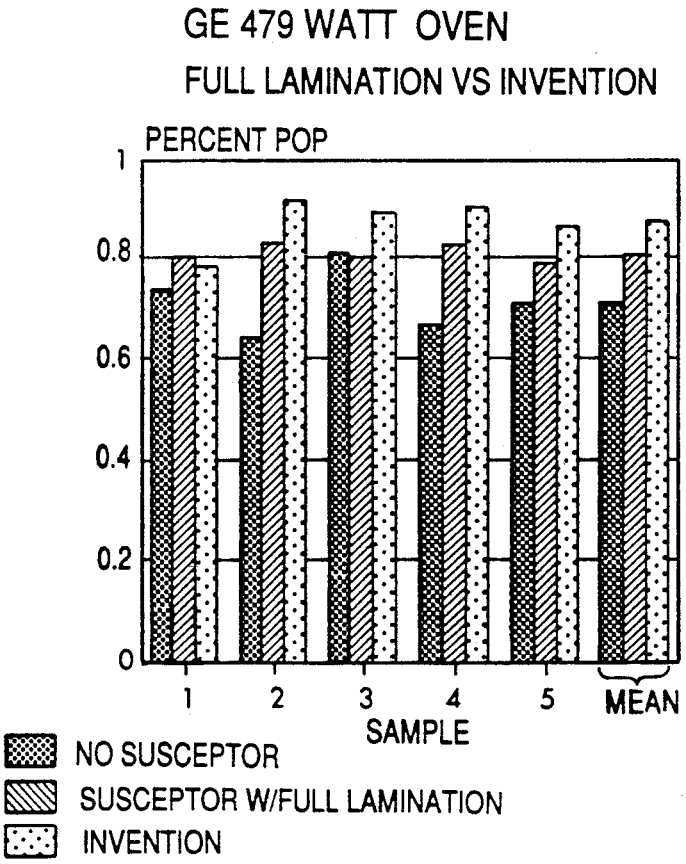
FIG. 8 is a similar to FIG. 7 but compares the percent of kernels that are popped.

Refer now to FIGS. 7–8 which show the effectiveness of the invention in popping popcorn in a microwave oven, in this case a GE 479-watt oven. Fifty-six grams of unpopped popcorn and 23.5 grams of shortening were placed in a bag having a height of 11 inches and a width of 4½ inches, and popped. It can be seen that by providing a susceptor and a full lamination, i.e. fully bonded between the sheets, a volume increase of from 1200 ml to 1600 ml is achieved. However, by using the invention, an additional increase from 1600 ml to about 1800 ml is achieved, a mean volume increase of about 19%. An increase is also achieved in the percent of the kernels that are popped, as shown in FIG. 8.

Figure 9:
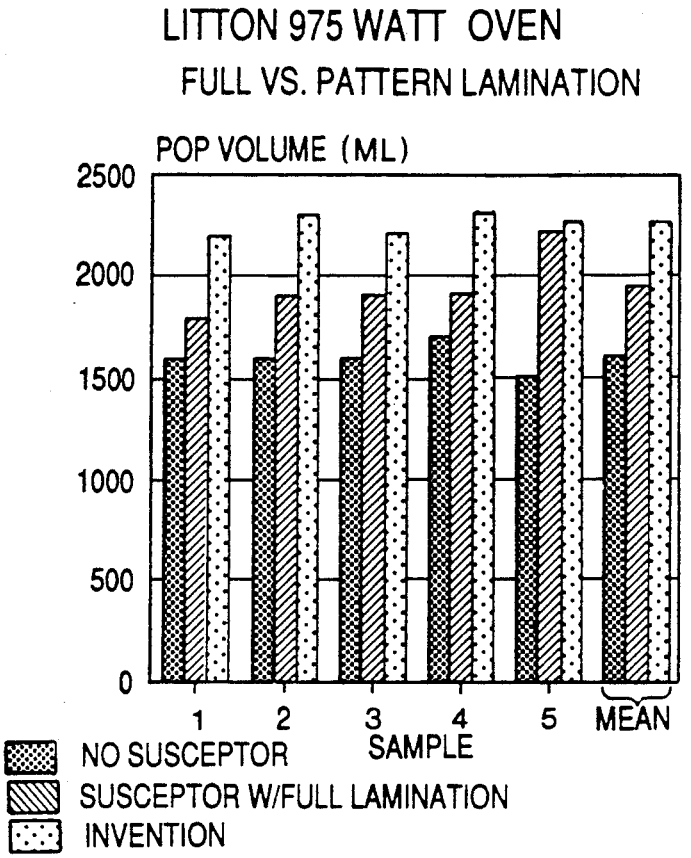
FIGS. 9 and 10 are similar to FIGS. 7 and 8 but show results achieved with a different microwave oven.
Figure 10:
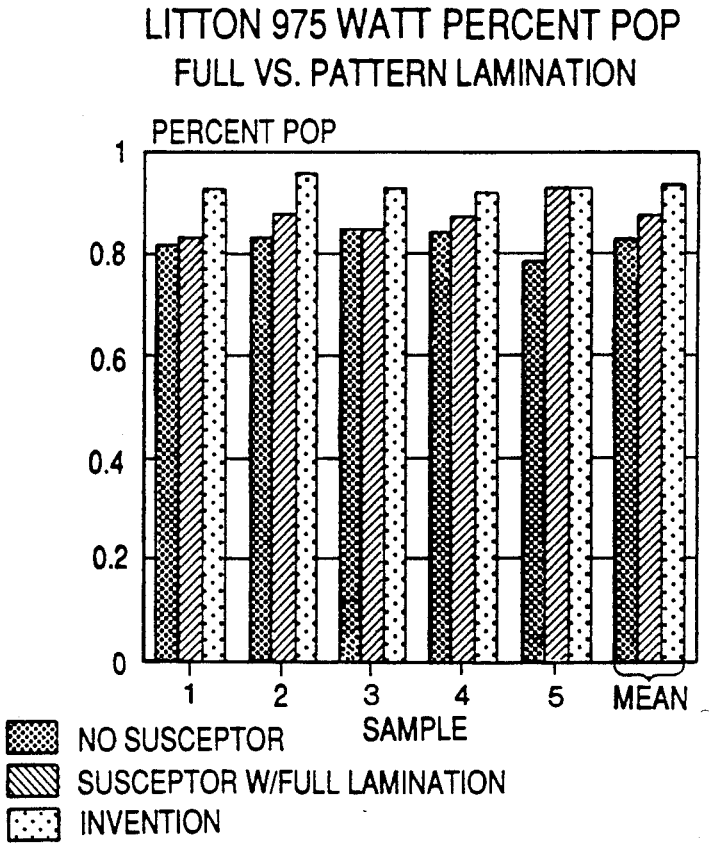

Refer now to FIGS. 9 and 10 which illustrate popping of popcorn in a Litton 975-watt oven.

As shown in FIG. 9 at the right as a mean of the samples tested with no susceptor, the volume of popped corn is about 1600 ml. When a susceptor is used with full lamination, i.e. adhesive applied over all of the mating surfaces, the volume increases to about 1900 ml. However, with the present invention there is a further volume increase to about 2300 ml, a mean volume increase of about 21%. Similar improvements are achieved in the percentage of the kernels popped as shown in FIG. 8.

Many variations of the present invention within the scope of the appended claims will be apparent to those skilled in the art once the principles described herein are understood.

What is claimed is:

1. An insulating microwave cooking package containing a compartment for heating food in a microwave oven, comprising:

at least inner and outer superimposed sheets of packaging material as a wall of the package, at least one of said sheets in the package wall being sufficiently flexible to change shape during microwave heating;

a microwave interactive susceptor layer positioned between said sheets and connected to the inner superimposed sheet of the package wall;

means connecting selected portions of the sheets together;

said package having at least one unsealed areas comprising sealed lines, dots or patches between the susceptor layer and the outer sheet to provide a plurality of flattened inflatable chambers between the sealed areas as a potential site for a plurality of inflated chambers separate from said compartment;

said inflation chambers are located in heat transfer relationship with the susceptor;

said inflation chambers are located between the susceptor and said outer sheet of the package;

the heat produced by the susceptor is adapted to expand the inflation chambers without placing moisture or other expandable material therein prior to heating; and said inflation chambers provide insulating spaces between the susceptor and said outer sheet of the package to form a thermal barrier for reducing heat loss from the package to thereby significantly enhance the cooking of the food.

2. The package of claim 1 wherein the chambers are provided in a bottom wall of the package, a food product is placed on an upper surface of the bottom wall whereby the inflation chambers are positioned between a floor of said microwave oven and the food product to reduce heat loss from the food to the oven floor.

3. The package according to claim 1 wherein the susceptor is provided between the chambers and an inner surface of the lower wall of the package.

4. The microwave heating package of claim 1 wherein the sealed areas comprise strips of adhesive intersecting at a point and extending radially outwardly from said point.

5. The package of claim 4 wherein the point of intersection corresponds generally with the center of a lower wall of the package to provide a plurality of radially arranged inflation chambers diverging from the point of intersection which, upon heating in a microwave oven, forms the lower wall of the package into a conical truss configuration with the apex of the conical truss projecting downwardly and corresponding to the point of intersection to help hold the food product within the package at the center of the cone.

6. The package of claim 1 wherein the sealed areas comprises a plurality of circles and the chambers comprise a multiplicity of blisters encompassed by circular sealed areas.

7. The package of claim 1 wherein the inflation chambers comprise a series of closed cells positioned adjacent to one another and having strips of sealing adhesive positioned between them to define the sealed areas.

8. The package of claim 1 wherein the superimposed sheets comprise at least two sheets of paper formed into a bag including said inner sheet and said outer sheet, said susceptor is bonded to the inner sheet in heat conductive relationship with a food product placed in the package, said flattened inflation chambers are located between said outer sheet and the susceptor and on the opposite side of the susceptor from the food product within the package.

9. The package of claim 1 wherein the package contains a food product, the food product is unpopped popcorn and the inflation of the chambers enhance the popping of the popcorn by increasing the volume of popped corn by at least about 15 percent.

* * * * *

UNITED STATES PATENT AND TRADEMARK OFFICE

CERTIFICATE OF CORRECTION

PATENT NO. : 5,081,330

DATED : January 14, 1992

INVENTOR(S) : L.C. Brandberg, et al

It is certified that error appears in the above-identified patent and that said Letters Patent is hereby corrected as shown below:

Column 5, line 46, cancel "at least one unsealed" and insert --a plurality of spaced apart sealed--.

Signed and Sealed this

Fourth Day of May, 1993

*Attest:*

Michael K. Kirk

MICHAEL K. KIRK

*Attesting Officer*

*Acting Commissioner of Patents and Trademarks*